US007225659B2

(12) United States Patent
Tomita

(10) Patent No.: US 7,225,659 B2
(45) Date of Patent: Jun. 5, 2007

(54) PUNCH PRESS DIE

(75) Inventor: Kazuo Tomita, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 132 days.

(21) Appl. No.: 10/516,316

(22) PCT Filed: Jun. 12, 2003

(86) PCT No.: PCT/JP03/07504

§ 371 (c)(1),
(2), (4) Date: Dec. 10, 2004

(87) PCT Pub. No.: WO03/106067

PCT Pub. Date: Dec. 24, 2003

(65) Prior Publication Data

US 2005/0217343 A1 Oct. 6, 2005

(30) Foreign Application Priority Data

Jun. 13, 2002 (JP) ..... 2002-172740

(51) Int. Cl.
*B21D 28/10* (2006.01)
*B21D 28/34* (2006.01)
*B21D 37/02* (2006.01)

(52) U.S. Cl. ..... 72/325; 72/413; 83/687

(58) Field of Classification Search ..... 72/325, 72/326, 477, 478, 413, 328; 83/687, 691, 83/688, 620, 622
See application file for complete search history.

(56) References Cited

U.S. PATENT DOCUMENTS 1,402,284 A * 1/1922 Daniels ..... 83/145
1,449,385 A * 3/1923 Dieterich ..... 72/326
1,468,271 A * 9/1923 Bechtel ..... 72/400
1,939,503 A * 12/1933 King ..... 83/687
2,017,247 A * 10/1935 Hodge ..... 279/76
3,077,135 A * 2/1963 Henn ..... 83/687
3,100,411 A * 8/1963 Airlie ..... 83/138
3,690,209 A * 9/1972 Gargrave et al. ..... 83/687
5,848,866 A 12/1998 Black, Jr.
6,189,361 B1 2/2001 Seki et al.
6,408,728 B1 * 6/2002 Tsuji et al. ..... 83/687
6,606,926 B1 * 8/2003 Tsuji et al. ..... 83/13

FOREIGN PATENT DOCUMENTS

JP 62-77124 4/1987

(Continued)

OTHER PUBLICATIONS

English Language Abstract of JP 5-285559.

(Continued)

*Primary Examiner*—Daniel C. Crane
(74) *Attorney, Agent, or Firm*—Greenblum & Bernstein, P.L.C.

(57) ABSTRACT

A punch press tool includes a cylindrical punch guide in which a punch body provided with a punch tip for press forming is fit slidably. The punch tip consists of an appropriate number of long forming punch tips each including a press forming portion in the leading end thereof. The punch tip also consists of an appropriate number of clamping punch tips each with a shorter length compared with the forming punch tips. Both of the tips are attached to the punch body detachably and exchangeably.

5 Claims, 17 Drawing Sheets

FOREIGN PATENT DOCUMENTS

| | | | |
|---|---|---|---|
| JP | 1-192429 | | 8/1989 |
| JP | 3-189021 | * | 9/1991 |
| JP | 4-80614 | | 7/1992 |
| JP | 5-285559 | | 11/1993 |
| JP | 5-317990 | | 12/1993 |
| JP | 6-15378 | | 1/1994 |

OTHER PUBLICATIONS

English Language Abstract of JP1-492429.
English Language Abstract of JP 62-7714.
English Language Abstract of JP5-317990.
English Language Abstract of JP 6-15378.

* cited by examiner

PUNCH PRESS DIE

This application is a 371 of PCT/JP03/07504, filed Jun. 12, 2003.

TECHNICAL FIELD

The present invention relates to a punch press tool that is used for forming a workpiece precisely, which is to be used for, for example, electronic parts, through a process consisting of upward or downward cut-and-raising and bending.

BACKGROUND ART

Conventionally, in order to form a bent part through, for example, a downward or upward cut-and-raising and bending process being performed on a portion of a workpiece that is to be used for, for example, electronic parts, a punch tool or die tool is made corresponding to the width of the bent part, and such tools are exchanged to be used for different widths.

However, using the individual tools discussed above causes a problem that it is necessary to make and prepare a large number of tools corresponding to various widths of respective bent parts. Moreover, there is another problem that the width of each of the bent parts cannot be designed freely.

The present invention is intended to solve the problems described above, and an object of the invention is to provide a punch press tool that is capable of forming a bent part with a freely-designed width by downward or upward cut-and-raising and bending.

DISCLOSURE OF THE INVENTION

In order to achieve the above object, a punch press tool according to a first aspect of the present invention comprises: a cylindrical punch guide; a punch body fitted slidably within the aforesaid punch guide; and a punch tip to perform press forming; wherein the aforesaid punch tip includes an appropriate number of long forming punch tips each including a press forming portion in the leading portion thereof and an appropriate number of clamping punch tip each having a shorter length compared with the forming punch tips; and both of the aforesaid tips are attached to the aforesaid punch body detachably and exchangeably.

A punch press tool according to a second aspect of the present invention is a punch press tool of the first aspect in which at least either the aforesaid forming punch tips and the aforesaid clamping punch tips are split into a plurality.

A punch press tool according to a third aspect of the present invention is a punch press tool according to the first or the second aspect in which provided is a stripper having a guide hole for receiving and guiding both of the aforesaid tips in the leading end side of the aforesaid punch guide and provided is a projected portion for clamping a workpiece in a position adjacent to the aforesaid guide hole located in the leading end of the aforesaid stripper.

A punch press tool according to a fourth aspect of the present invention comprises: a die base; a die body supported on the aforesaid die base; and a die tip held in the aforesaid die body; wherein the aforesaid die tip comprises an appropriate number of forming die tips each including a forming portion in the leading end thereof and an appropriate number of sub die tips each having a smaller size compared with the forming die tips; and both of the aforesaid tips are attached to the aforesaid die body detachably and exchangeably.

A punch press tool according to a fifth aspect of the present invention is a punch press tool according to the fourth aspect in which at least either the aforesaid forming die tips or the sub die tips are split into a plurality.

A punch press tool according to a sixth aspect of the present invention comprises: a punch holder for the punch press; a sliding body supported slidably within the aforesaid punch holder; and a punch tip for performing press forming, which punch tip is attached to the leading end of the aforesaid sliding body; wherein the aforesaid punch tip includes an appropriate number of long forming punch tips each including a press forming portion in the leading end thereof and an appropriate number of clamping punch tips each having a shorter length compared with the forming punch tips; and the aforesaid forming punch tips and the aforesaid clamping punch tip are attached to the aforesaid sliding body detachably and exchangeably.

A punch press tool according to a seventh aspect of the present invention is a punch press tool according to the sixth aspect in which at least either the aforesaid forming punch tips or the aforesaid clamping punch tips are split into a plurality.

Thus, by means of combining appropriately the aforesaid forming punch tips, the aforesaid clamping punch tips, the aforesaid forming die tips and the aforesaid sub die tips, a downward or upward cut-and-raised and bent part can be formed in a portion of a workpiece.

In addition, by means of selecting the width for each of the aforesaid tips, the width and the spacing of a bent part can be selected freely, and the punch tips and the die tips can be exchanged for forming various bent parts having various bent width.

Furthermore, when forming into a downward cut-and-raised and bent part in a workpiece, the workpiece can be clamped between the projected portion provided in the leading end of the stripper and the clamping punch tip, so that a bent part can be obtained with high accuracy.

THE BEST MODE FOR CARRYING OUT THE INVENTION

Hereunder, the best mode of carrying out the present invention will be described in detail referring to the attached drawings.

Figure 1:
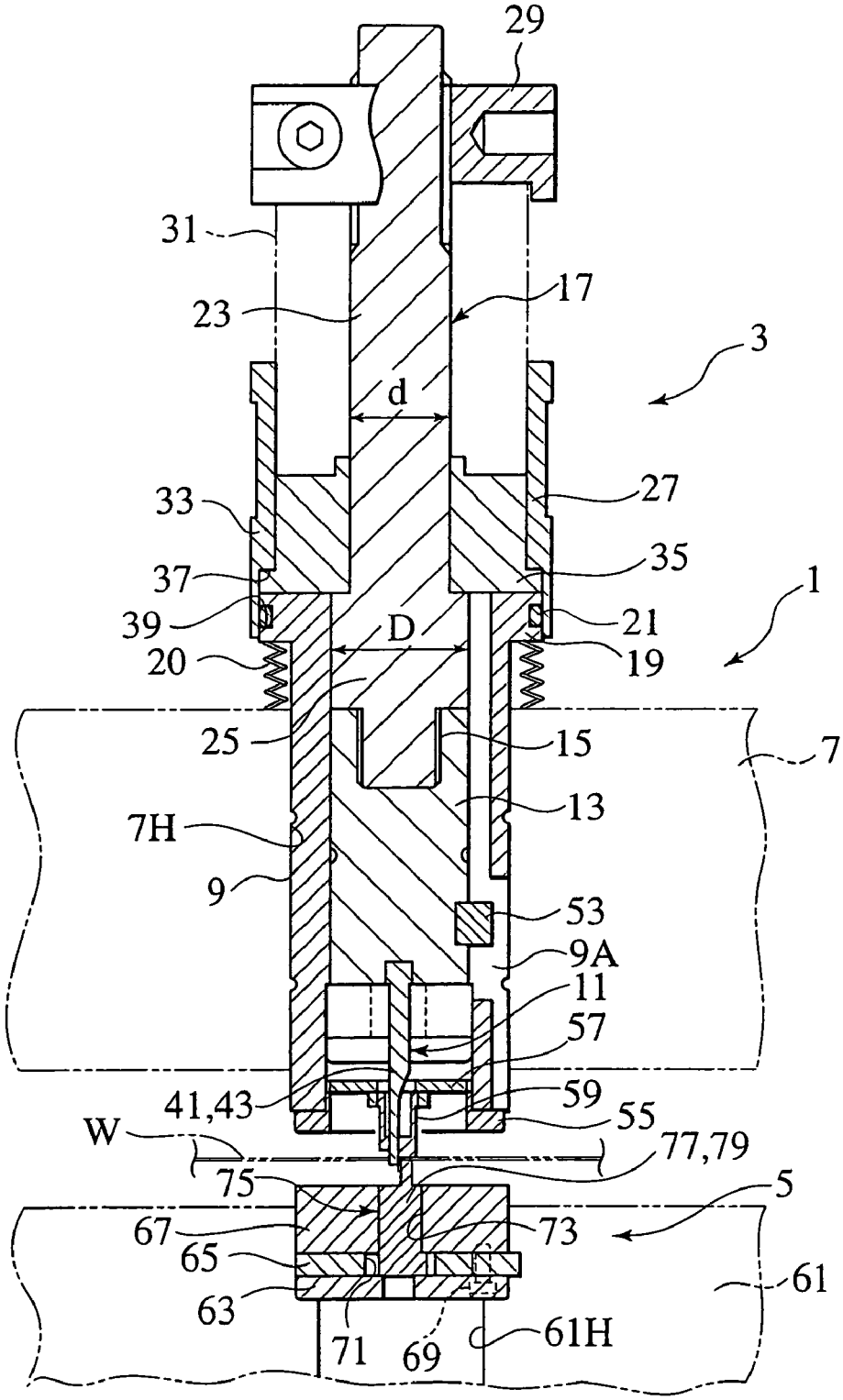
FIG. 1 shows a cross-sectional front view of a punch press tool for executing the present invention.

FIG. 1 shows a punch press tool 1 of high precision according to the present invention. This punch press tool 1 is constructed of a punch tool 3 and a die tool 5. In the aforesaid punch tool 3, a punch guide 9 is provided to be slidable upward and downward within a hole 7H formed in a upper die supporting member 7 that serves as a punch holder. Within the punch guide 9, supported slidably upward and downward (upward and downward in FIG. 1) are a punch tip 11, a punch body 13 provided detachably on the upper side of the punch tip 11 and a punch driver 17 connected integrally to the punch body 13 by means of a threaded portion 15.

There is provided a flange portion 19 on the upper end of the aforesaid punch guide 9. This flange portion 19 includes a locking groove 39 formed on a circumference surface thereof, and an O ring 21 as a locking member is inserted into the locking groove 39. The aforesaid punch driver 17 consists of a middle portion 23 with an outer diameter d and a lower portion 25 with an outer diameter 25, in which the outer diameter d is adapted to be smaller than the outer diameter D. And a retainer collar 27 having an inner diameter smaller than the outer diameter D of the lower portion 25 is provided slidably upward and downward outside the middle portion 23. Accordingly, the retainer collar 27 is slidable along only the middle portion 23 of the punch driver 17. Further, a punch head 29 is mounted on the upper end of the punch driver 17.

Between the retainer collar 27 and the punch head 29, a resiliently stripping member such as a stripper spring 31 is provided for constantly biasing the retainer collar 27 and punch head 29 to press them apart.

Surrounding the peripheries of the retainer collar 27 and the stripper spring 31, a slide collar 33 that servers as a fixing member is disposed slidably. On the internal surface of the lower end of the slide collar 33, a locking projection 37 is formed. This locking projection 37 serves to press downward a clamping projection 35 formed in the lower end of the retainer collar 27 so as to allow the lower end of the slide collar 33 to engage lockably the O-ring 21 disposed in the flange portion 19 of the punch guide 9. Between the flange portion 19 of the aforesaid punch guide 9 and the upper surface of the upper die supporting member 7, a lifter spring 20 is disposed for biasing upward the punch guide 9 constantly.

Figure 2A:
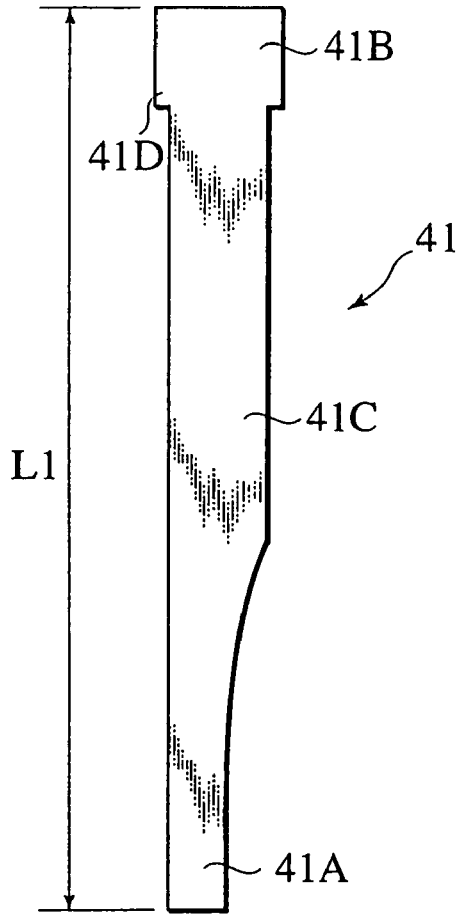
FIG. 2A shows a cross-sectional front view of a punch tip for downward forming.
Figure 2B:
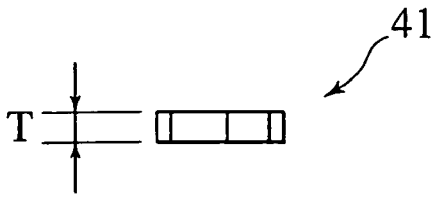
FIG. 2B shows a bottom view of a punch tip for downward forming.
Figure 3A:
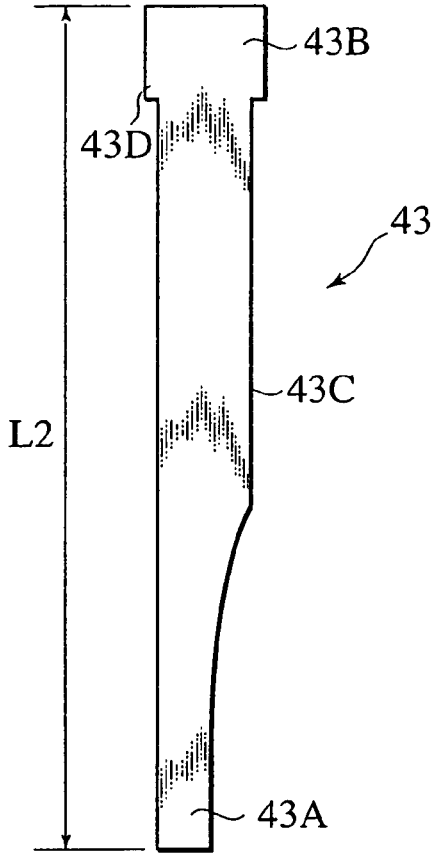
FIG. 3A shows a cross-sectional front view of a punch tip for downward clamping.
Figure 3B:
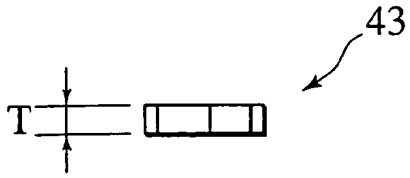
FIG. 3B shows a bottom view of a punch tip for downward clamping.

Referring to FIG. 2A together with FIG. 2B, FIG. 3A and FIG. 3B, the aforesaid punch tip 11 comprises an appropriate number of forming punch tips 41 each of which includes a press forming portion in the leading end portion thereof and has a length L1 and an appropriate number of clamping punch tips 43 each of which has a shorter length L2 compared with that of the forming punch tip 41 (L2<L1). Both tips 41 and 43 are received in the aforesaid punch body 13 detachably.

FIG. 2A and FIG. 2B show the forming punch tip 41. Referring to FIG. 2A, the head portion 41B has projections 41D in the bottom thereof, which projections project toward right and left with respect to the body portion 41C so as to make a step in the vertical direction. FIG. 3A and FIG. 3B show the aforesaid clamping punch tip 43. Referring to FIG. 3A, in the similar manner to the forming punch tip, the head portion 43B has projections 43D in the bottom thereof, which projections project toward right and left with respect to the body portion 43C so as to make a step in the vertical direction.

The aforesaid forming punch tips 41 are prepared preliminarily with various widths T such as the width T1 for one piece and the width 2T1 for two pieces. Also, the aforesaid clamping punch tips 43 are prepared preliminarily with various widths T such as the width T1 for two pieces, the width 1.5T1 for two pieces and the width 2T1 for one piece.

Figure 4:
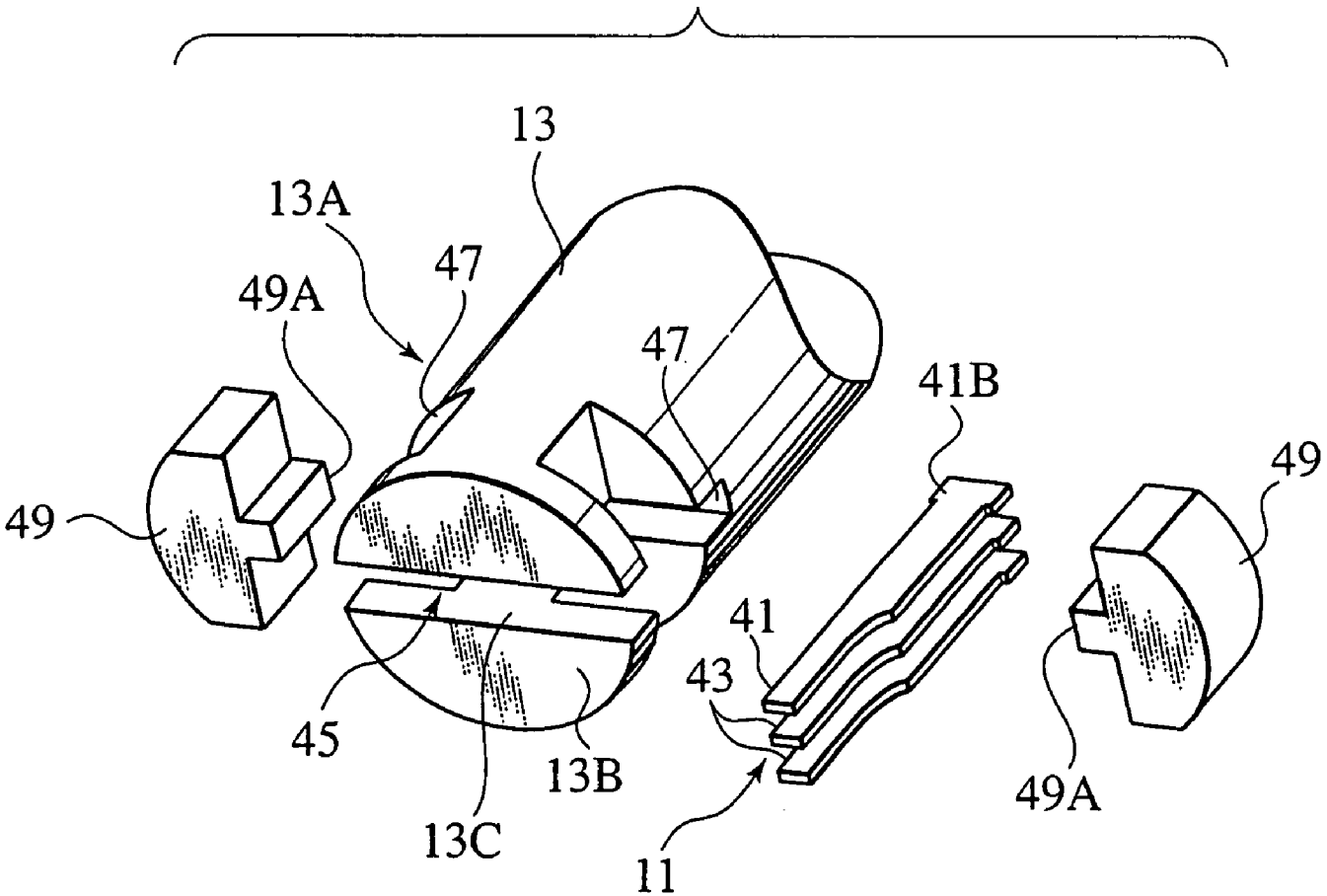
FIG. 4 shows an exploded perspective view of a leading end of a punch body, which end receives punch tips disengageably.
Figure 5:
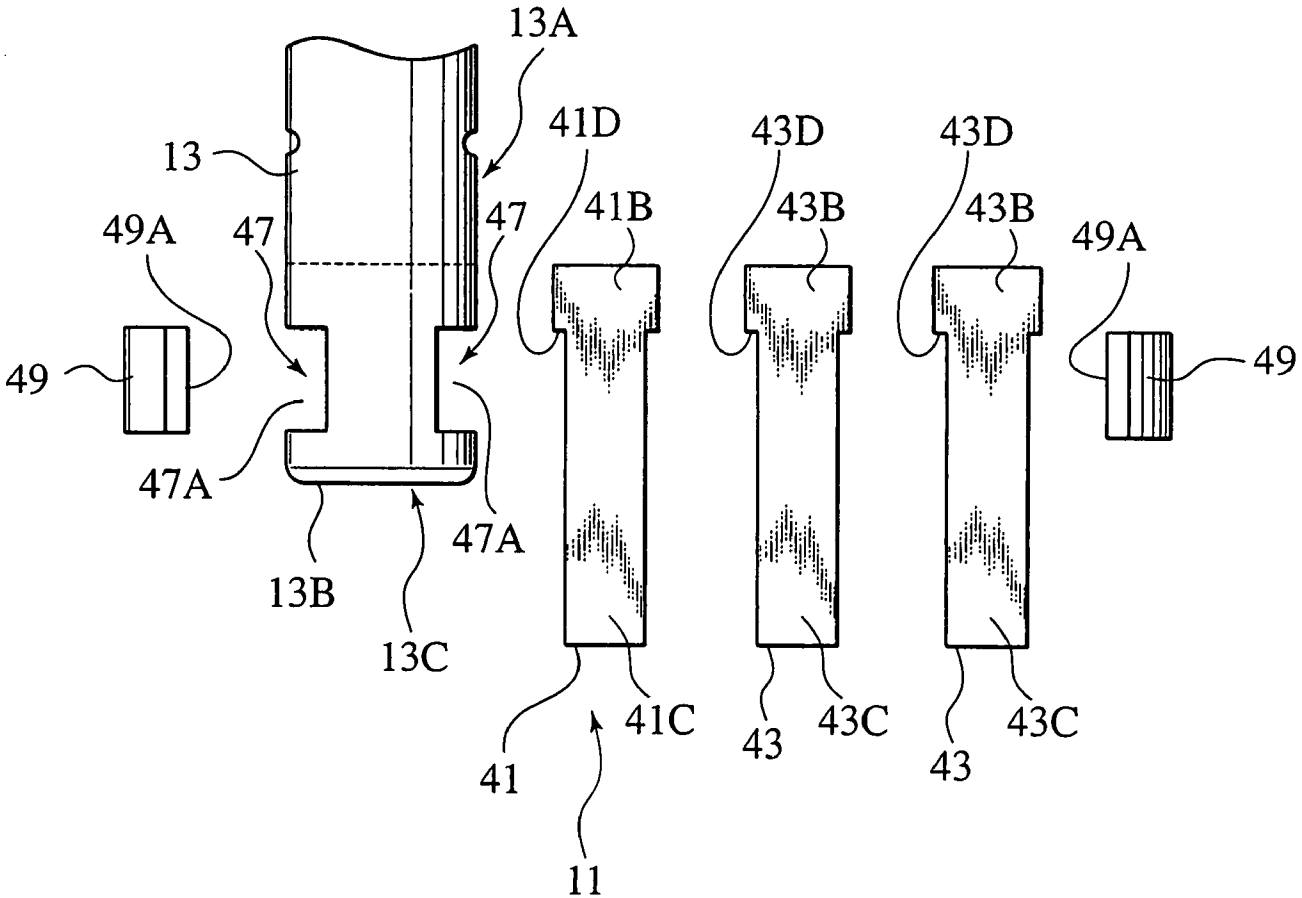
FIG. 5 shows an exploded front view of a leading end of a punch body, which end receives punch tips disengageably.

Referring also to FIG. 4 and FIG. 5, in the leading end portion 13A of the aforesaid punch body 13, a punch receiving recess 45 including an opening 13C is formed in the leading end surface 13B. Further, in the leading end portion 13A of the punch body 13, locking recesses 47 including openings 47A formed on the periphery surfaces thereof and communicating with the aforesaid punch receiving recess 45 are formed. A locking piece 49 is provided with an engaging surface 49A in an inner side thereof, which is adapted to be engageable with a peripheral surface of the punch tip 11 attached inside the aforesaid punch receiving recess 45. The locking piece 49 is disposed detachably in one of the aforesaid locking recesses 47, and the paired locking piece is disposed in the other locking recess located oppositely to the foregoing locking recess. The engaging surface 49A of the aforesaid locking piece 49 is formed with the shape corresponding to a shape of the outer periphery of the punch tip 11.

The forming punch tip 41 and the clamping punch tip 43, both of which compose the aforesaid punch tip 11, are provided with the projections 41D and 43D respectively on the respective head portions 41B and 43B thereof, which projections project horizontally with respect to the aforesaid locking recess 47 and are engageable with the engaging surface 49A of the aforesaid locking piece 49. Moreover, the aforesaid punch body 13 is provided with a key 53 in the peripheral surface thereof, and this key 53 is received in a key groove 9A that is formed on the punch guide 9.

Figure 6A:
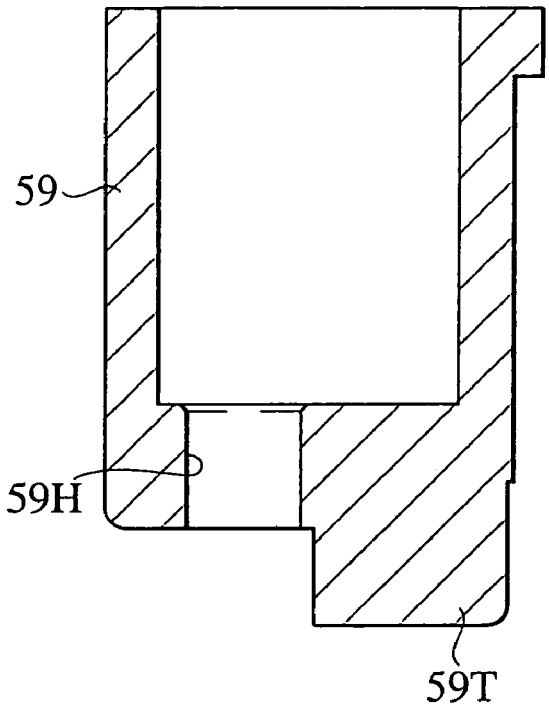
FIG. 6A shows a cross-sectional front view of a stripper.
Figure 6B:
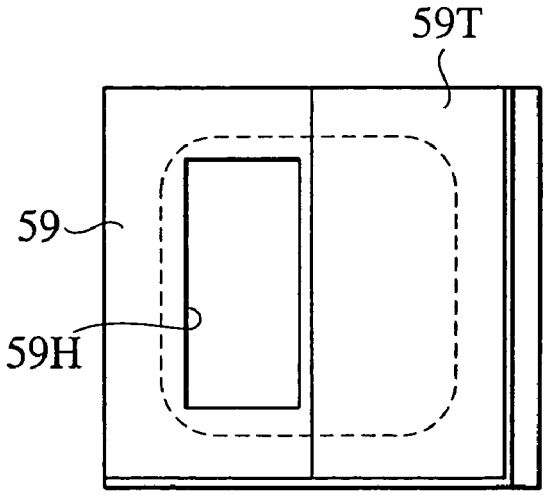
FIG. 6B shows a bottom view of a stripper.

At the leading end (lower end) of the aforesaid punch guide 9, a cross-shaped plate 55 is fitted, and inside this plate 55 a cross-shaped plate 57 is fixed by means of a bolt or the like. Referring also to FIG. 6A and FIG. 6B, at the center of this plate 57 a stripper 59 is disposed, which stripper is formed with a guide hole 59H for receiving and guiding the aforesaid punch tip 11 composed of the forming punch tips 41 and the clamping punch tips 43. On the leading end of this stripper 59, a projected portion 59T is disposed adjacent to the aforesaid guide hole 59H, which projected portion serves for clamping the work sheet.

Figure 7A:
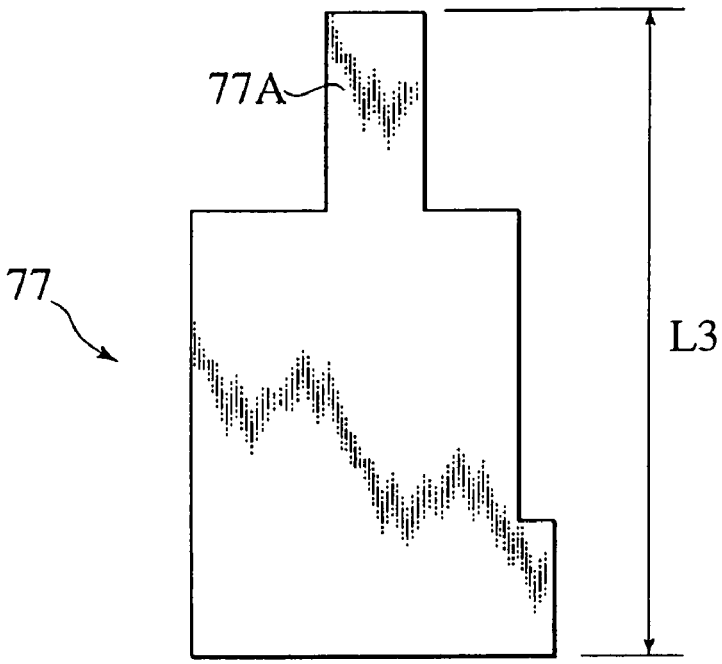
FIG. 7A shows a cross-sectional front view of a die tip for downward forming.
Figure 7B:
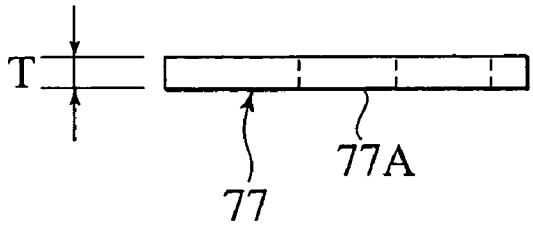
FIG. 7B shows a plan view of a die tip for downward forming.
Figure 8A:
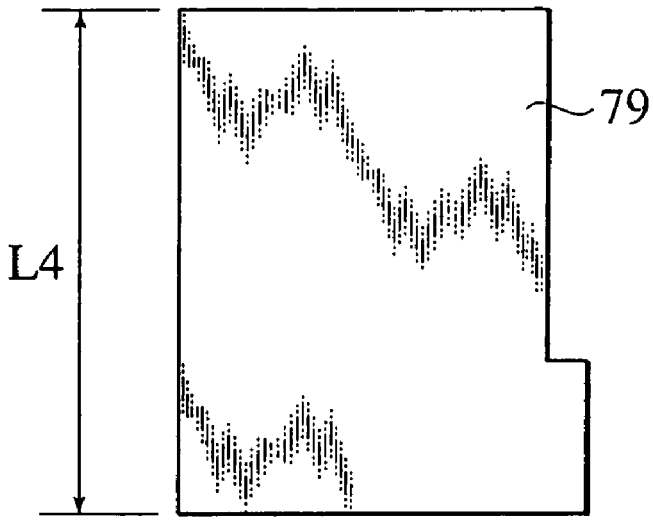
FIG. 8A shows a cross-sectional front view of a downward sub die tip.
Figure 8B:
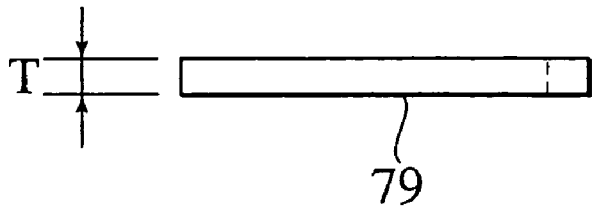
FIG. 8B shows a plan view of a downward sub die tip.

The aforesaid die tool 5 is, as shown in FIG. 1, mounted within a mounting hole 61H disposed in the lower die supporting member 61, and a die body 67 is supported on a die base 63 via a die holder 65 and fastened by means of a bolt 69. Within respective holes 71 and 73 that are formed in the center of the aforesaid die holder 65 and the die body 67 respectively, a die tip 75 is held detachably. The aforesaid die tip 75 comprises an appropriate number of the forming die tips 77, which have a size L3, having a forming portion 77A as shown in FIG. 7A and FIG. 7B as well as an appropriate number of the sub die tips 79, which have a size L4 smaller than L3 (L4<L3), as shown in FIG. 8A and FIG. 8B. Such tips, i.e., the forming die tips 77 and the sub die tips 79 are disposed detachably and exchangeably in the aforesaid die body 67.

The aforesaid forming die tips 77 are prepared preliminarily with various widths T such as width T1 for one piece and width 2T1 for two pieces. Also, the aforesaid sub die tips 79 are prepared preliminarily with various widths such as width T1 for two pieces, width 1.5T1 for two pieces and width 2T1 for one piece.

According to the construction described above, as shown in FIG. 5, the appropriate number of forming punch tips 41 and the appropriate number of clamping punch tips 43 are bound together to form the punch tip 11. Such bound tips are inserted from the right in the figure into an opening formed in the leading end surface of the punch receiving recess 45 that is disposed in the leading end portion 13A of the punch body 13. And, when a pair of the locking pieces 49 are mounted within the locking recess 47, which is formed in such a manner that the openings 47A formed on the peripheral surface of the leading end portion 13A of the aforesaid punch body 13 communicate with the aforesaid punch receiving recess 45, the engaging surface 49 formed in the inner side of the locking piece 49 comes to engage the peripheral surface of the punch tip 11. The punch body 13 including the punch tip 11 is accommodated in the hole 9H formed in the punch guide 9, which is shown in FIG. 1.

As shown in FIG. 1, when the top of the punch head 29 is struck by means of a striker that is not shown, the punch guide 9 moves downward against the bias of the lifter spring 20. While the punch guide 9 moves downward further, the lower surface of the projected portion 59T of the stripper 59 and the upper surface of the forming die tip 77 hold the workpiece cooperatively, and the forming die tip 77 performs to cut-and-raise and to bend downward for forming a bent part.

Figure 9A:
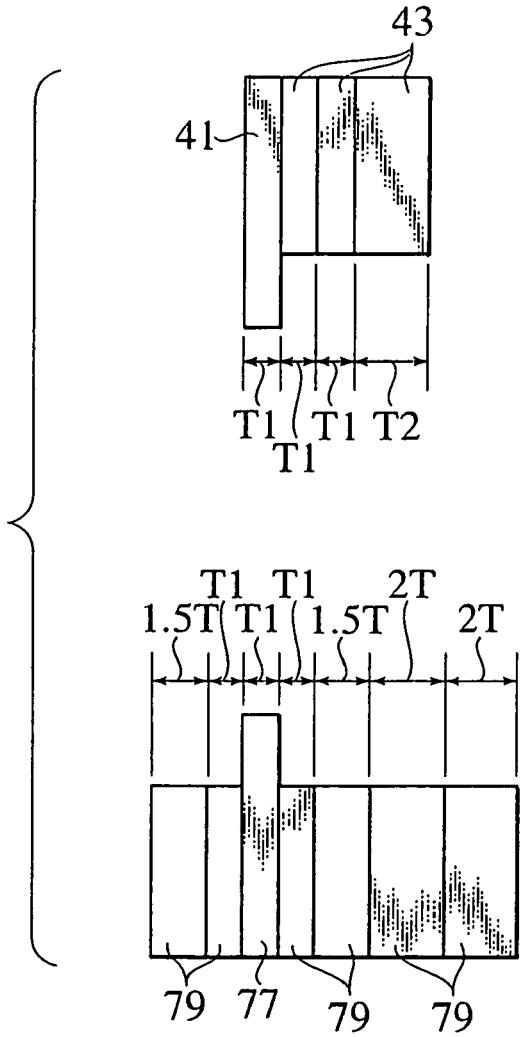
FIG. 9A shows a side view of an example of combinations of a punch tip for downward forming with punch tips for downward clamping and of a die tip for downward forming with downward sub die tips.
Figure 9B:
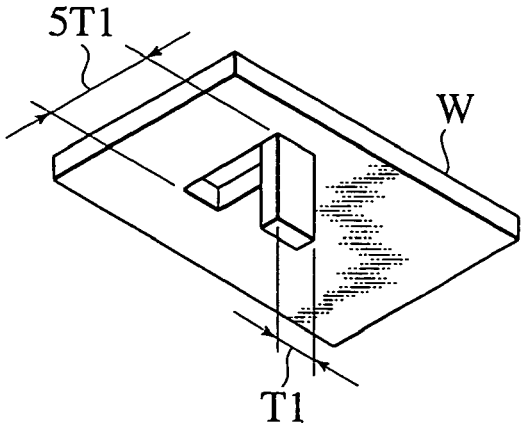
FIG. 9B shows a perspective view of an example of a workpiece provided with a downward bent part that is formed with the tools shown in the foregoing FIG. 9A.

By way of example, as shown in FIG. 9A, one piece of the forming punch tip 41 with the width T1, two pieces of the clamping punch tips 43 with the width T1 and one piece of the clamping punch tip 43 with the width T2, and one piece of the forming die tip 77 with the width T1, two pieces of the sub die tips 79 with the width T1, two pieces of the sub die tips 79 with the width 1.5T1 and two pieces of the sub die tips 79 with the width 2T1 are combined together into two sets. And when such combinations are used for bending a workpiece downward, a downward cut-and-raised and bent part can be obtained as shown in FIG. 9B.

Figure 10A:
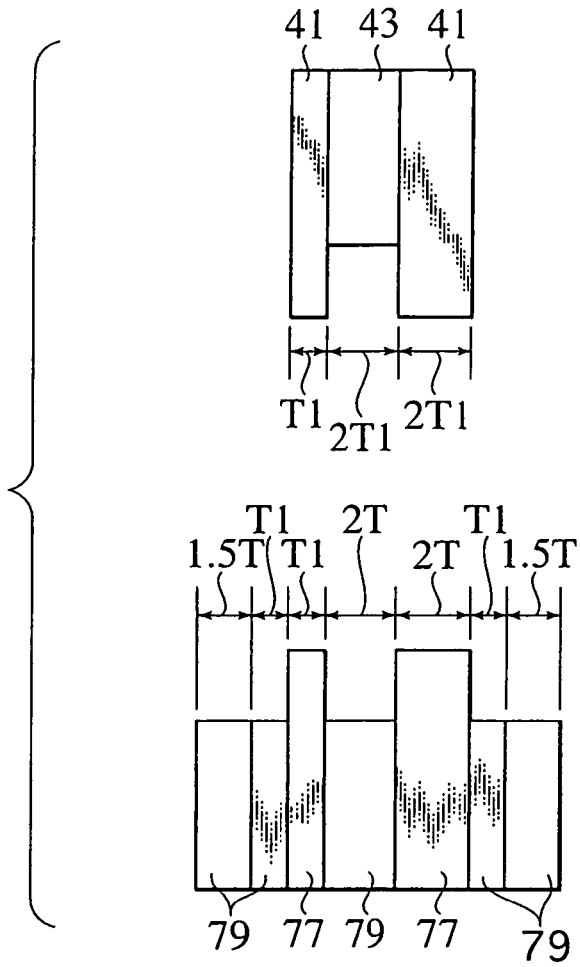
FIG. 10A shows a side view of an example of combinations of punch tips for forming and a punch tip for clamping and of die tips for forming and sub die tips.
Figure 10B:
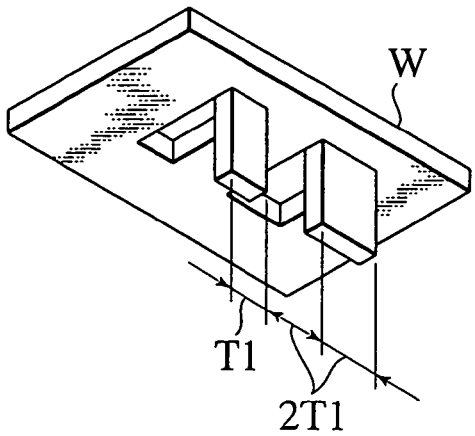
FIG. 10B shows a perspective view of another example of a workpiece provided with downward bent parts that are formed with the tools shown in the foregoing FIG. 10A.

Alternatively, as shown in FIG. 10A by way of example, one piece of the forming punch tip 41 with the width T1, one piece of the forming punch tip 41 with the width 2T1 and one piece of the clamping punch tip 43 with the width 21T, and one piece of the forming die tip 77 with the width T1, one piece of the forming die tip 77 with the width 2T1, two pieces of the sub die tips 79 with the width T1, two pieces of the sub die tips 79 with the width 1.5T1 and one piece of the sub die tip 79 with the width 2T1 are combined together into two sets. And when such combinations are used for bending a workpiece downward, a downward cut-and-raised and bent part can be obtained as shown in FIG. 10B.

Furthermore, by making use of the forming punch tip 41, the clamping punch tip 43, the forming die tip 77 and the sub die tip 79, and by making various combinations through varying the width and the number of these tips, various bent parts that have bent widths other than discussed above and appropriate spacing can be obtained.

Figure 11:
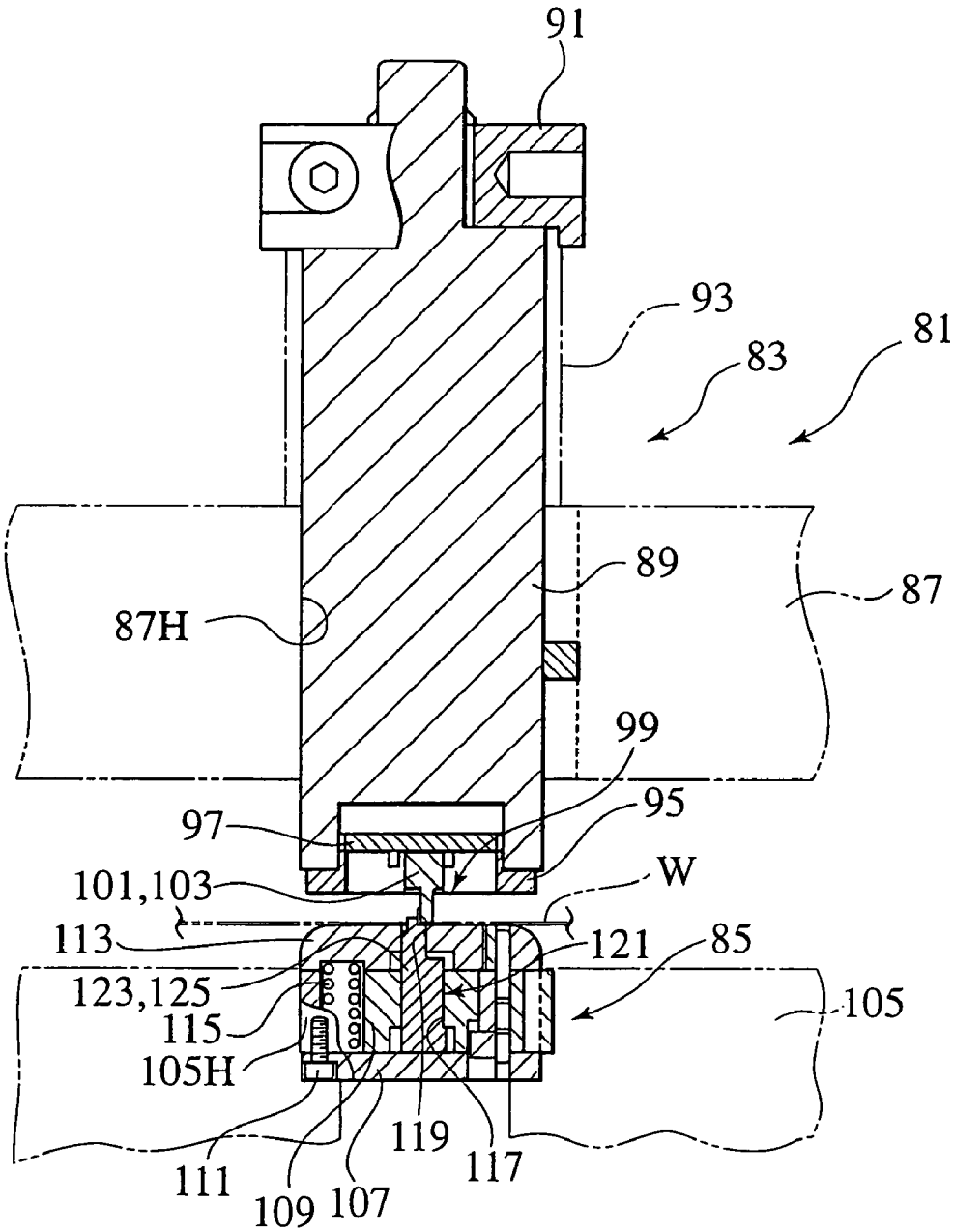
FIG. 11 shows a cross-sectional front view of a punch press tool according to an embodiment other than the die shown in FIG. 1.

FIG. 11 shows a punch tool 81, which is an alternative to the same shown in FIG. 1, for a high precision punch press according to another embodiment of the present invention. In FIG. 11, it is shown that the punch tool 81 of a punch press comprises a punch tool 83 and a die tool 85.

In the aforesaid punch tool 83, there is included an upper die supporting member 87 as a punch holder, which member is provided with a hole 87H. A punch body 89 as a sliding body is accommodated in this hole slidably upward and downward. On the top of the punch body 89, a punch head is mounted. Between a lower surface of the punch head 91 and an upper surface of the aforesaid upper die supporting member 87, there is interposed a lifter spring 93 that biases the punch body 89 upward normally.

In the leading end (lower end) of the aforesaid punch body 89, a cross-shaped plate 95 is fitted, and another cross-shaped plate 97 is fixed to the forgoing plate 95 by means of a bolt or the like. Furthermore, a punch tip 99 is inserted into the center portion of the aforesaid plate 95.

Figure 12A:
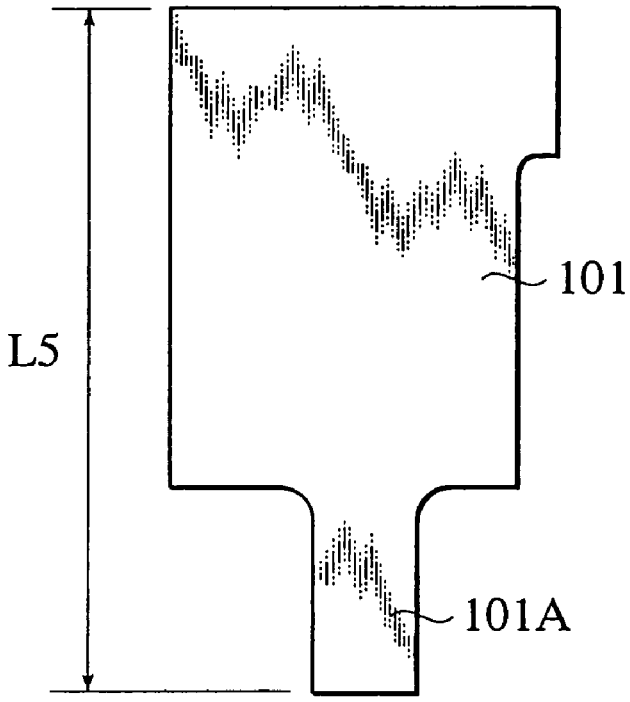
FIG. 12A shows a cross-sectional front view of a punch tip for upward forming.
Figure 12B:
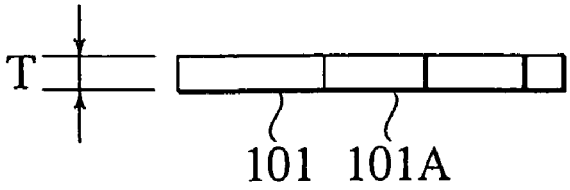
FIG. 12B shows a bottom view of a punch tip for upward forming.
Figure 13A:
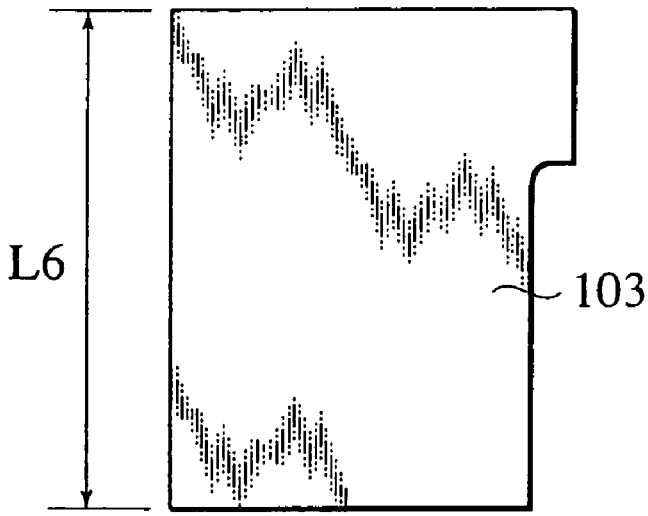
FIG. 13A shows a cross-sectional front view of a punch tip for upward clamping.
Figure 13B:
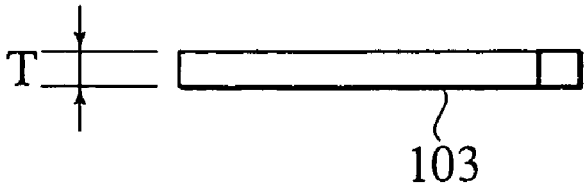
FIG. 13B shows a bottom view of a punch tip for upward clamping.

The punch tip 99 comprises, referring to FIG. 12A together with FIG. 12B, FIG. 13A and FIG. 13B, an appropriate number of forming punch tips 101, each of which is provided with a press forming portion 101A in the leading end thereof and has a long size L5, and an appropriate number of clamping punch tips 103, each of which has a size L6 (L6<L5) shorter than that of the forming punch tip 101. Both of the aforesaid tips 101 and 103 are attached to the aforesaid punch body 89 exchangeably.

The aforesaid forming punch tips 101 are prepared preliminarily with various widths such as the width T1 for one piece, width 2T1 for two pieces and the width T3 for one piece. Also, the aforesaid clamping punch tips 103 are prepared preliminarily with various widths such as the width T1 for two pieces, the width 1.5T1 for two pieces and the width 2T1 for one piece.

The aforesaid die tool 85 is, as shown in FIG. 11, accommodated in a mounting hole 105H disposed in a lower die supporting member 105, and a die holder 109 is fixed on a die base 107 by means of a bolt 111. On the die holder 109, an ejector plate 113 is mounted, and this ejector plate 113 is biased against the die holder 109 upward normally by means of a spring 115.

Figure 14A:
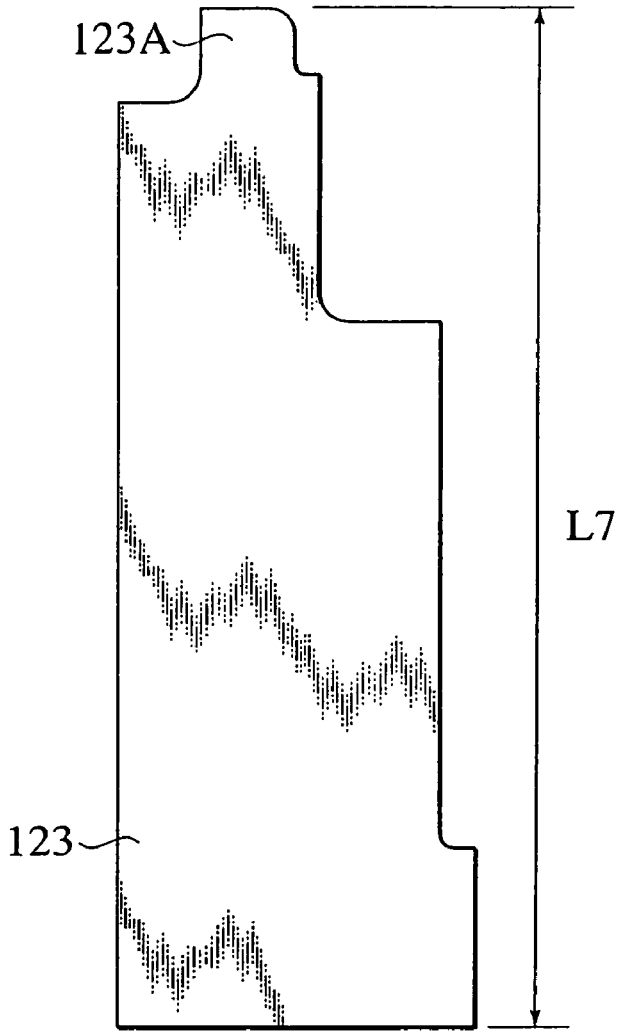
FIG. 14A shows a cross-sectional front view of a die tip for upward forming.
Figure 14B:
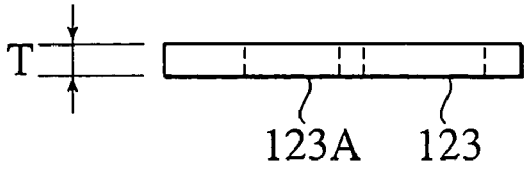
FIG. 14B shows a plan view of a die tip for upward forming.
Figure 15A:
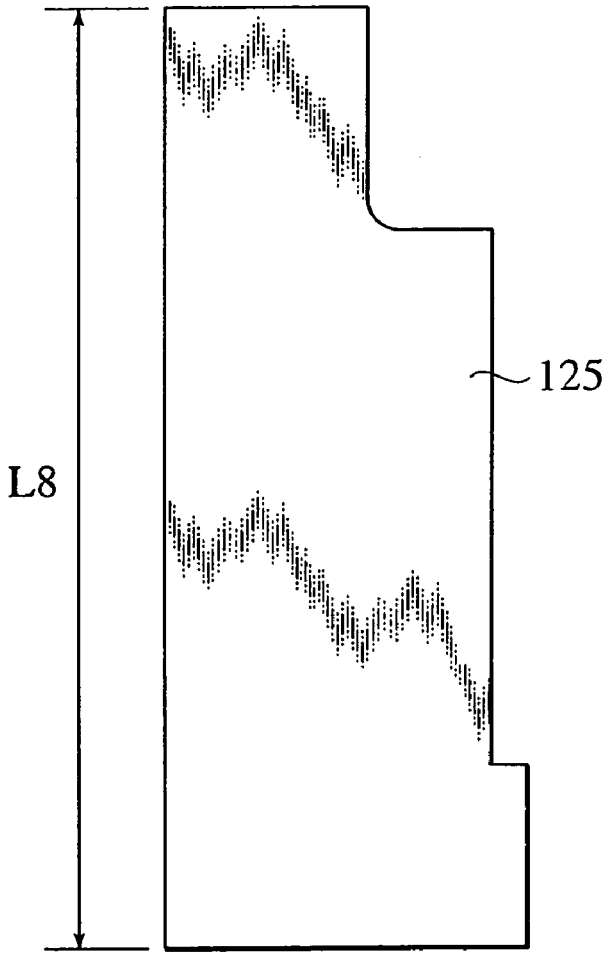
FIG. 15A shows a cross-sectional front view of a downward sub die tip.
Figure 15B:
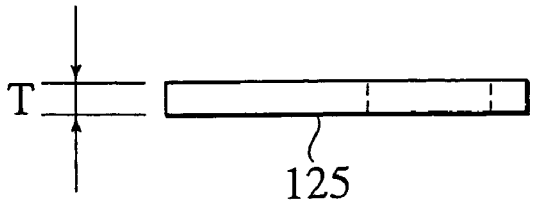
FIG. 15B shows a plan view of a downward sub die tip.

Within holes 117 and 119 formed in the center of each of the aforesaid die holder 109 and the ejector plate 113, the die tip 121 is held detachably. The aforesaid die tip 121 comprises, as shown in FIG. 14A and FIG. 14B, an appropriate number of die tips 123, each of which is provided with a forming portion 123A in the leading end (upper end) thereof and has a size L7, and an appropriate number of sub die tips 125 each having a size L8 smaller than L7 (L8<L7). A combination of both of the forming die tips 123 and the sub die tips 125 is attached to the aforesaid die holder 109 detachably and exchangeably.

The aforesaid forming die tips 123 are prepared preliminarily with various widths T such as the width T1 for one piece, the width 2T1 for two pieces and the width T3 for one piece. Also, the aforesaid sub die tips 125 are prepared preliminarily with various widths T such as the width T1 for two pieces, the width 1.5T1 for two piece and the width 2T1 for one piece.

According to the construction described above, as shown in FIG. 11, when the leading end of the punch head 91 is struck with a striker that is not shown, the punch body 89 moves downward against the biasing force from the lifter spring 93. While the punch body 89 moves downward further, the lower surface of the forming punch 101 presses the upper surface of the aforesaid ejector plate 113 against the biasing force from the spring 115 and the upper surface of the forming die tip 123 presses upward the workpiece, so that an upward cut-and-raised part can be obtained.

Figure 16A:
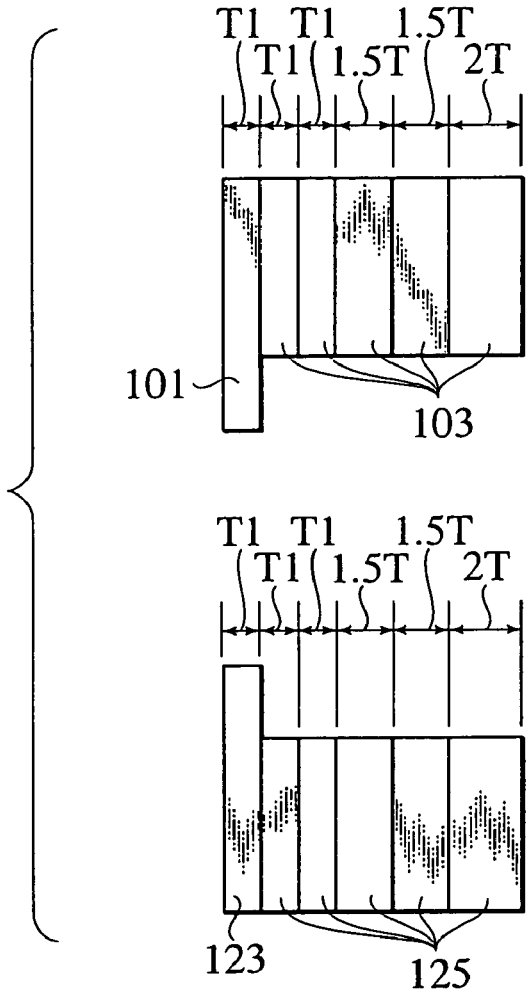
FIG. 16A shows a side view of an example of combinations of a punch tip for upward forming with punch tips for clamping and of a die tip for forming with sub die tips.
Figure 16B:
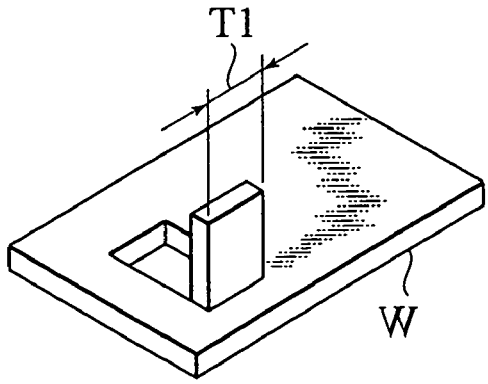
FIG. 16B shows a perspective view of an example of a workpiece provided with an upward bent part that is formed with the tools shown in the foregoing FIG. 16A.

By way of example, as shown in FIG. 16A, one piece of the forming punch tip 101 with the width T1, two pieces of the clamping punch tips 103 with the width T1 two pieces of the clamping punch tips 103 with the width 1.5T1 and one piece of the clamping punch tip 103 with the width T2 and one piece of the forming die tip 123 with the width T1 two pieces of the sub die tips 125 with the width T1 two pieces of the sub die tips 125 with the width 1.5T1 and one piece of the sub die tip 125 with the width 2T1 are combined together into two sets. When performing an upward cut-and-raising and bending on a workpiece W by means of these sets, an upward cut-and-raised and bet part shown in FIG. 16B can be obtained.

Figure 17A:
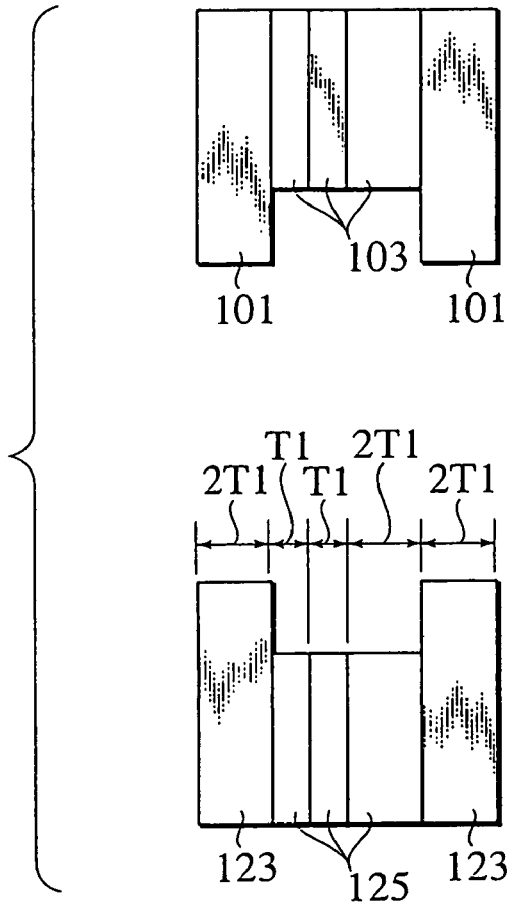
FIG. 17A shows a side view of an example of combinations of punch tips for upward forming with punch tips for clamping and of die tips for forming with sub die tips.
Figure 17B:
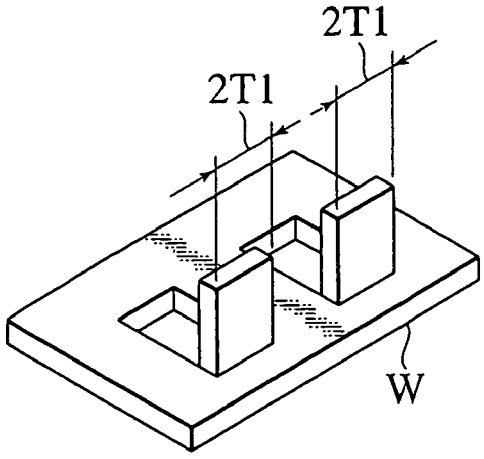
FIG. 17B shows a perspective view of another example of a workpiece provided with an upward bent part that is formed with the tools shown in the foregoing FIG. 17A.

Alternatively, as shown in FIG. 17A, two pieces of the forming punch tips 101 with the width 2T1 two pieces of the clamping punch tips 103 with the width T1 and one piece of the forming punch tip 101 with the width 2T1 and two pieces of the forming die tips 123 with the width 2T1 two pieces of the sub die tips 125 with the width T1 and one piece of the sub die tip 125 with the width 2T1 are combined together into two sets. When performing an upward cut-and-raising and bending on a workpiece W by means of these sets, an upward cut-and-raised and bent part shown in FIG. 17B can be obtained.

Furthermore, by making use of the forming punch tips 101, the clamping punch tips 103, the forming die tips 123 and the sub die tips 125 and by making various combinations through varying the width and the number of these tips, various bent parts which have bent widths other than discussed above and appropriate spacing can be obtained.

It should be noted that all of the substances of the Japan Patent Application No. 2002-172740 filed on Jun. 13, 2002 be incorporated in this specification by a reference.

Furthermore, the present invention should not be limited by the embodiment of the present invention described above, and other embodiments may be executed by providing appropriate changes to the present invention.

The invention claimed is:

1. A punch press tool comprising:

a cylindrical punch guide;

a punch body fit slidably into said punch guide; and a punch tip comprising at least one forming punch tip detachably and exchangeably attached to said punch body and at least one clamping punch tip detachably and exchangeably attached to said punch body, wherein said at least one forming punch tip each includes a press forming portion in a leading end;

wherein a length of each of said at least one clamping punch tip is shorter than a length of each of said at least one forming punch tip;

wherein at least one of said at least one forming punch tip and said at least one clamping punch tip comprises a plurality of punch tips;

wherein said punch guide is provided with a stripper in a leading end thereof, said stripper including a guide hole that receives and guides said at least one forming punch tip and said at least one clamping punch tip, and wherein said stripper is provided with a projected portion that clamps a workpiece in a position adjacent to said guide hole.

2. A punch press tool according to claim 1, further comprising:

a die base;

a die body supported on said die base; and a die tip held in said die body and comprising at least one forming die tip detachably and exchangeably attached to said die body and at least one sub die tip detachably and exchangeably attached to said die body, wherein said at least one forming die tip each includes a forming portion in a leading end thereof, and wherein a size of each of said at least one sub die tip is smaller than a size of each of said at least one forming die tip.

3. The punch press tool according to claim 2, wherein at least one of said at least one forming die tip and said at least one of said sub die tip comprises a plurality of die tips.

4. A punch press tool, comprising:

a punch holder for a punch press;

a sliding body supported slidably within said punch holder; and a punch tip that performs press forming, said punch tip being provided in a leading end of said sliding body and comprising at least one forming punch tip detachably and exchangeably attached to said sliding body and at least one clamping punch tip detachably and exchangeably attached to said sliding body, wherein each of said at least one forming punch tip includes a press forming portion in a leading end thereof;

wherein a length of each of said at least one clamping punch tip is shorter than a length of each of said at least one forming punch tip;

wherein said punch holder is provided with a stripper in a leading end thereof, said stripper including a guide hole that receives and guides said at least one forming punch tip and said at least one clamping punch tip, and wherein said stripper is provided with a projected portion that clamps a workpiece in a position adjacent to said guide hole.

5. The punch press tool according to claim 4, wherein at least one of said at least one forming punch tip and said at least one clamping punch tip comprises a plurality of punch tips.

* * * * *